United States Patent [19]

Ueno et al.

[11] Patent Number: 4,828,010

[45] Date of Patent: May 9, 1989

[54] HORIZONTAL MOLD CLAMPING AND VERTICAL INJECTION TYPE DIE CASTING METHOD AND APPARATUS

[75] Inventors: Toyoaki Ueno; Masashi Uchida; Sadayuki Dannoura, all of Yamaguchi, Japan

[73] Assignee: Ube Industries, Ltd., Ube, Japan

[21] Appl. No.: 164,251

[22] Filed: Mar. 4, 1988

[30] Foreign Application Priority Data

Mar. 6, 1987 [JP] Japan ..... 62-50314

[51] Int. Cl.[4] ..... B22D 29/00

[52] U.S. Cl. ..... 164/113; 164/131; 164/132; 164/342; 164/344

[58] Field of Search ..... 164/340, 341, 342, 343, 164/344, 345, 346, 347, 312, 131, 132; 425/450.1, 556, 557, DIG. 58, 554; 264/328.11

[56] References Cited

U.S. PATENT DOCUMENTS

| | | | |
|---|---|---|---|
| 2,055,944 | 9/1936 | Polak | 164/347 |
| 3,443,628 | 5/1969 | Carr | 425/556 |
| 3,741,284 | 6/1973 | Davis | 164/347 |
| 3,938,585 | 2/1976 | Radar | 164/347 |
| 4,198,371 | 4/1980 | Holmes | 425/556 |
| 4,655,274 | 4/1987 | Dannoura | 164/341 |
| 4,690,197 | 9/1987 | Dannoura | 164/312 |

FOREIGN PATENT DOCUMENTS

| | | | |
|---|---|---|---|
| 275505 | 8/1951 | Fed. Rep. of Germany | 164/347 |
| 59-232810 | 12/1984 | Japan | 164/342 |
| 443773 | 4/1975 | U.S.S.R. | 425/DIG. 58 |

*Primary Examiner*—Kuang Y. Lin

*Attorney, Agent, or Firm*—Blakely, Sokoloff, Taylor & Zafman

[57] ABSTRACT

In a horizontal mold clamping and vertical injection type die cast machine, when molds are opened, a product is held by a product holding device. When mold opening is completed, the product is pushed out by a product push out device mounted to a stationary metal mold side of the machine.

3 Claims, 2 Drawing Sheets

HORIZONTAL MOLD CLAMPING AND VERTICAL INJECTION TYPE DIE CASTING METHOD AND APPARATUS

BACKGROUND OF THE INVENTION

The present invention relates to a horizontal mold clamping and vertical injection type die casting method and apparatus, wherein a molten metal is casted into a cavity of a metal mold, clamped in the horizontal direction, from the lower direction.

Die casting methods and apparatuses therefor are classified into those of a horizontal mold clamping type and those of a vertical mold clamping type according to the mold clamping direction, and are also classified into those of a vertical injection type and those of a horizontal injection type according to the molten metal injection direction. Among them, the horizontal mold clamping and vertical injection type die casting method and an apparatus therefor are developed by the present applicant and disclosed in U.S. Pat. Nos. 4,655,274 and 4,690,197. This method and the apparatus therefor are widely practically used since they have many excellent points, e.g., a temperature decrease in molten metal due to a contact with a casting sleeve is low, gas entrainment of the molten metal in the sleeve is small, and degassing of the cavity can be performed well, thus providing good cast products.

FIG. 1 is a partially sectional side view of a die cast machine for explaining the conventional die casting method of this type. The conventional die casting method will be described with reference to FIG. 1. A stationary platen 2 and a link housing 3 are fixed by tie rods 4 at four corners thereof and oppose each other on a machine base 1. A movable platen 5 is supported by the tie rods 4 such that it is horizontally movable with respect to the stationary platen 2. A stationary metal mold 6 is mounted on the stationary platen 2 and a movable metal mold 7 is mounted on the movable platen 5. The metal molds 6 and 7 oppose each other. A cavity 8 as a hollow portion is formed in the split or mating plane of the mated metal molds 6 and 7, as shown in FIG. 1. A mold clamping cylinder 9 is fixed to the central portion of the housing 3. The operating end of a piston rod 10 of the cylinder 9 is connected to a part of a toggle mechanism 11 provided between the movable platen 5 and the link housing 3. When the mold clamping cylinder 9 is operated, the movable platen 5 is moved forward/backward to mate or clamp/open the metal molds 6 and 7. A plurality of brackets 12 are fixed to the movable metal mold 7, and core cylinders 13 are mounted to the respective brackets 12. A slide core 15 is provided to the piston rod of each core cylinder 13. When the piston rods of the core cylinders 13 are moved forward/backward, the slide cores 15 are engaged/disengaged with/from the undercut portion of the cavity 8.

An injection cylinder unit 17 is pivotally supported by a support frame 16 extending downward from the lower end of the stationary platen 2 and can stand upright or be tilted. A block 20 is bonded to the upper end of an injection cylinder 18 as a main portion of the injection cylinder unit 17 and is vertically moved by a cylinder 19. A casting sleeve 21 is supported by the block 20 and inserted in a sleeve hole defined by the metal molds 6 and 7. When the cylinder 19 is operated, the casting sleeve 21 is vertically moved together with the block 20 and engaged with or disengaged from the metal molds 6 and 7. A tilting cylinder 22 is supported by the support frame 16 through a bracket 23. When the casting sleeve 21 is disengaged form the metal molds 6 and 7, the tilting cylinder 22 tilts the entire portion of the injection cylinder unit 17 to supply molten metal into the casting sleeve 21. A plunger tip (not shown) for moving forward/backward within the casting sleeve 21 is coupled to the piston rod of the injection cylinder 18. When the plunger tip is moved upward, the molten metal is injected into the cavity 8.

A push out cylinder 24 of a product push out device is mounted to the central portion of the counter-metal mold side of the movable platen 5. A push out plate 25 is fixed to the piston rod of the push out cylinder 24. A plurality of connecting rods 26, each having an end fixed to the push out plate 25, extend through the movable platen 5 and project into the hollow portion of the movable metal mold 7. A push out plate 27 is mounted to the projecting ends of the connecting rods 26. A plurality of push out pins 28, each having an end held by the push out plate 27, extend through the movable metal mold 7 and project to the interior of the cavity 8. When the molds are opened, the push out pins 28 are moved forward by the push out cylinder 24 and push the product out of the cavity 8. A manifold 29 having a valve is fixed to the movable platen 5 and distributes pressurized oil to the core and push out cylinders 13 and 24.

With the above arrangement, the molds 6 and 7 are clamped as shown in FIG. 1, the injection cylinder 18 is tilted to supply the molten metal into the casting cylinder 21, and the injection cylinder 18 is caused to stand upright. The casting sleeve 21 is inserted into the sleeve hole defined by the metal molds 6 and 7, and the plunger tip of the piston rod in the injection cylinder 18 is moved forward to cast the molten metal into the cavity 8. After the molten metal in the cavity 8 is solidified and cooled, the mold clamping cylinder 9 is operated. Then, the movable platen 5 is moved backward through the toggle mechanism 11 and the movable metal mold 7 is moved backward to open the molds 6 and 7. In this case, the slide core 15 is closed and the product is held by the movable metal mold 7. Thus, the molds 6 and 7 are opened while the product is attached to the movable metal mold 7. When mold opening is completed, the core cylinder is operated to move the slide core 15 upward to disengage it from the product. Then, the push out cylinder 24 is operated so that the push out plate 25, the connecting rod 26, the push out plate 27, and the push out pin 28 are integrally moved forward and the product is pushed. The pushed product is picked up by a product pickup device (not shown) from the casting machine.

However, in the conventional horizontal mold clamping and vertical injection type die casting machine described above, a product push out operation can be started only after the molds are completely opened and the slide core 15 is opened since otherwise the product can undesirably fall. Since a time required for product push out in a single die casting cycle time is considerably increased, the entire cycle time cannot be shortened, thus resulting in high manufacturing cost. Regarding the mold opening operation, not only the movable platen 5 and the movable metal mold 7 are moved, but also heavy components such as the product push out device, the core cylinder 13, and the manifold 29, as well as the product, must be moved. It takes time for these components to reach the maximum speed, overcoming static friction, from the still state. As a result, the time required for product push out is further elongated, and the power consumption is increased.

SUMMARY OF THE INVENTION

It is, therefore, an object of the present invention to provide a horizontal mold clamping and vertical injection type die casting method and apparatus, wherein the above-described drawbacks of the conventional technique are eliminated.

The horizontal mold clamping and vertical injection type die casting method according to the present invention comprises the steps of, after molten metal casted in a metal mold cavity is solidified, opening the molds while leaving the solidified product to the stationary metal mold side, and pushing out the product with a product push out device of the stationary metal mold side when the mold opening operation is completed.

A horizontal mold clamping and vertical injection type die casting apparatus according to the present invention comprises a device, provided to the stationary metal mold side, for holding a product when the molds are opened, and a device for pushing out the product.

DETAILED DESCRIPTION OF THE PREFERRED EMBODIMENT

A preferred embodiment of the present invention will be described in detail with reference to FIG. 2.

Figure 1:
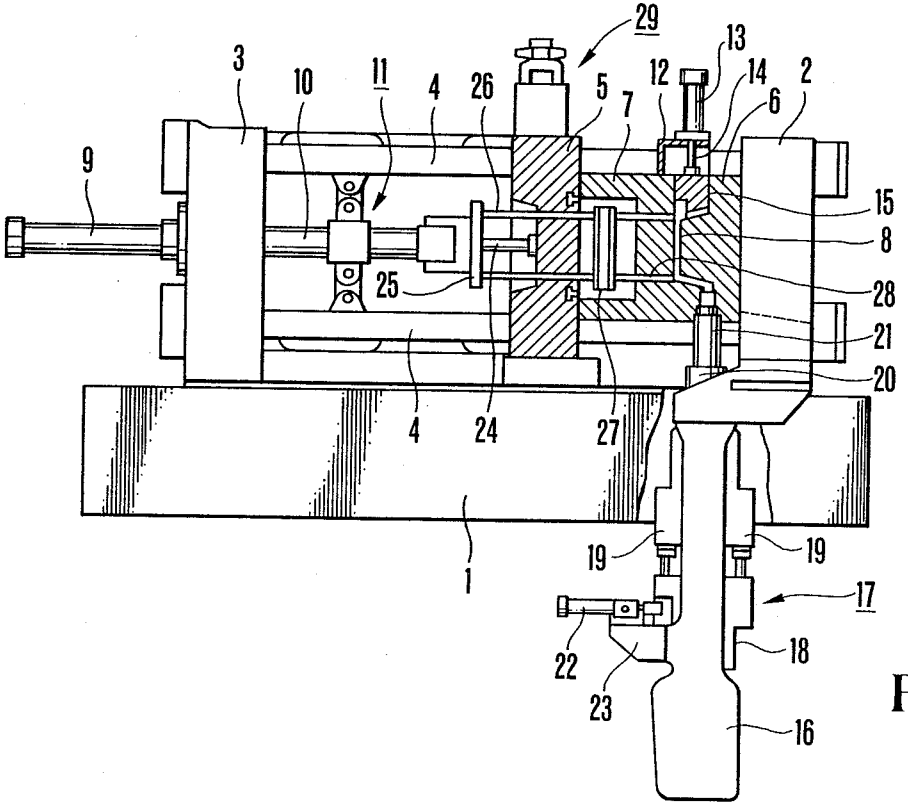
FIG. 1 (PRIOR ART)
FIG. 1 is a longitudinal sectional view of a conventional horizontal mold clamping and vertical injection type die cast machine.
Figure 2:
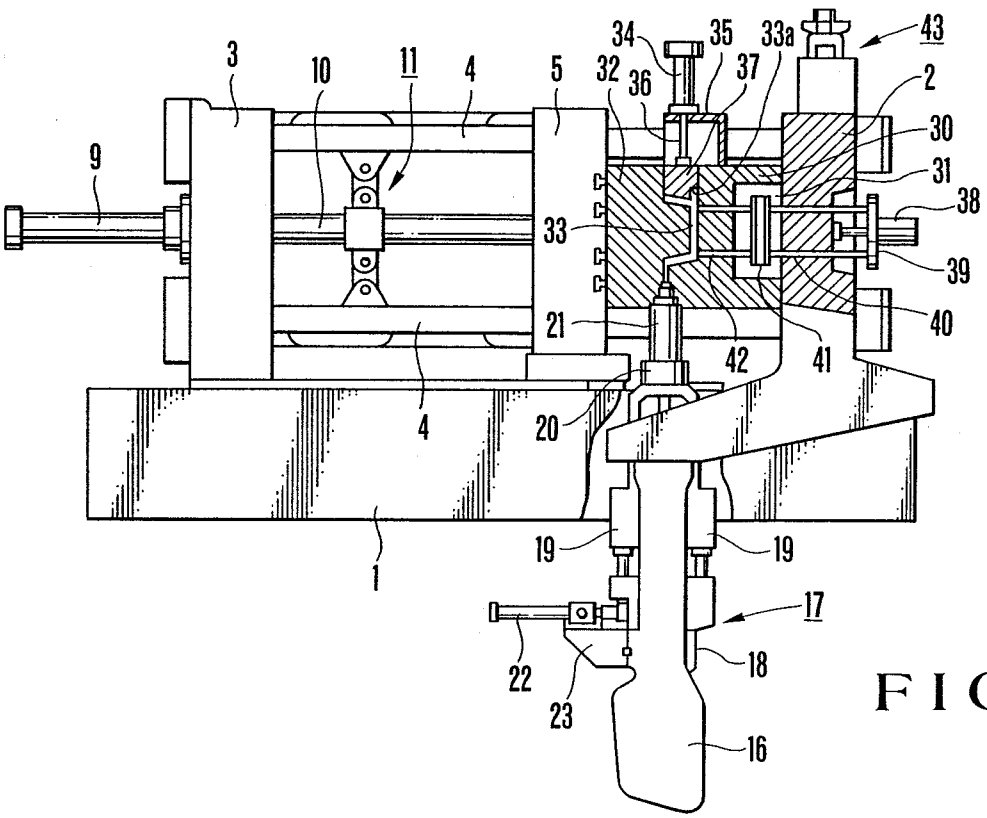
FIG. 2 is a longitudinal sectional view of a horizontal mold clamping and vertical injection type die cast machine according to an embodiment of the present invention.

The same reference numerals in FIG. 2 denote the same components as in the conventional die cast machine shown in FIG. 1 and a detailed description thereof is omitted. The same components as in FIG. 1 will be briefly described. Tie rods 4 connect a stationary platen 2 and a link housing 3 on a machine base 1, and a movable platen 5 moved by a mold clamping cylinder 9 through a toggle mechanism 11 is supported by the tie rods 4. A support frame 16 extends downward from the stationary platen 2, and an injection cylinder unit 17 which is caused to stand upright or tilted by a tilting cylinder 22 is pivotally supported by the support frame 16. The injection cylinder unit 17 has an injection cylinder 18 and a casting sleeve 21 supported by a block 20 and vertically moved by a cylinder 18.

A stationary metal mold 30 is fixed to the stationary platen 2 to define a hollow portion 31 together with the stationary platen 2. A thin, comparatively lightweight movable metal mold 32, which does not have additional equipment such as a product push out device, as in the conventional case, is fixed to the movable platen 5. A cavity 33 is defined in the mating plane of the clamped metal molds 30 and 32. A lower end of the cavity 33 defined in this manner serves as a reception port for receiving the casting sleeve 21. The block 20 is moved downward by the cylinder 19, the entire portion of the cylinder unit 17 is tilted by the tilting cylinder 22, and molten metal is injected into the casting sleeve 21. Thereafter, the cylinder unit 17 is returned to the upright state by the tilting cylinder 22. Then, the casting sleeve 21 is moved upward together with the block 20 and is engaged with the reception port formed in the lower end of the cavity 33. The molten metal is injected into the cavity 33 by the injection cylinder 18.

A plurality of core cylinders 34 are also used as product holding devices. The core cylinders 34 are fixed to the stationary metal mold 30 side and supported by corresponding brackets 35. Slide cores 37 are mounted on the operating ends of piston rods 36 of the core cylinders 34, respectively, and engaged between the metal molds 30 and 32. An undercut portion **33*a* is formed at the bottom of the corresponding slide core 37. A push out cylinder 38 of a stationary piston rod type is mounted to the central portion of the counter metal mold side of the stationary platen 2 and serves as a product push out device. A plate 39 is fixed to the cylinder 38. A plurality of connecting rods 40, each having an end fixed to the plate 39, slidably extend through the holes in the stationary platen 2 and project into the hollow portion 31. A plate 41 is fixed to the projecting ends of the connecting rods 40. A plurality of push out pins 42 are held by the push out plate 41 at its ends. The other end of each push out pin 42 extends through the corresponding pin hole of the stationary metal mold 30 and opposes the inner surface of the cavity 33. A manifold 43 having a valve supplies pressurized oil to the core cylinders 34 and the push out cylinder 38 at a predetermined timing and is fixed to the stationary platen 2**.

A die casting method using the die casting apparatus having the above arrangement will be described. The casting sleeve 21 is moved downward by the cylinder 19 from the state shown in FIG. 2 wherein the molds 30 and 32 are clamped to disengage the metal molds 30 and 32 from each other. The entire structure of the injection cylinder unit 17 is tilted by the tilting cylinder 22, and the molten metal is supplied into the casting sleeve 21. After the molten metal is supplied, the injection cylinder unit 17 is caused to stand upright, the casting sleeve 21 is moved upward by the cylinder 19, and the casting sleeve 21 is engaged with the reception port formed at the lower end of the cavity 33. Subsequently, the injection cylinder 18 is operated, and the plunger tip is moved upward to cast the molten metal in the casting sleeve 21 into the cavity 33.

Solidification and cooling of the molten metal in the cavity 33 are waited. Then, when the pressurized oil is supplied to the rod side of the mold clamping cylinder 9, the movable platen 5 is moved backward through the toggle mechanism 11, and the movable metal mold 32 is separated from the stationary metal mold 30 to perform mold opening. During mold opening, each slide core 37 holds the product at a position of the cavity 33 by the undercut portion **33*a*. Therefore, the product is left in the stationary metal mold 30 side, and the movable metal mold 32 is separated without accompanying the product. Since nothing except the movable metal mold 32 is mounted to the movable platen 5** side, the weight of the components moving during mold opening is small. Even when the components move from the still state, they are accelerated to reach their maximum speed within a considerably short period of time.

Once mold opening is started, product push out operation is started at the start of mold opening, during mold opening, or at the completion of mold opening at latest. More specifically, when the core cylinders 34 are operated immediately after mold opening starts, the slide cores 37 are moved backward to disengage the undercut portion **33*a* thereof from the product, and a product pickup device (not shown) is inserted between the metal molds 30 and 32. When the push out cylinder 38 is operated, the plate 39, the connecting rod 40, the push out plate 41, and the push out pin 42 are integrally moved forward and push the product out of the position of the cavity 33**. The product pickup device picks up the product and conveys it outside the machine. In this manner, the product push out operation or a preparatory operation for it can be started immediately after the start of mold opening. As a result, the operation time is shortened compared to a conventional case wherein a held product cannot be released before the completion of mold opening.

In this embodiment, as a device for holding the product during mold opening, the core cylinder 34 and the slide core 37 are provided and hold the product with the undercut portion 33*a*. In another embodiment, the core cylinder is not provided, and the push out pins 42 projects slightly into the cavity 33. With this construction, the product is held by frictional resistance with the slightly projected end of the push out pins 42.

As is apparent from the above description, according to the horizontal mold clamping and vertical injection type die casting method of the present invention, after molten metal casted into a metal mold cavity is solidified, the molds are opened while leaving the solidified product of the molten metal on the stationary metal mold side. An operation for pushing out the product by the product push out device of the stationary metal mold side is started when mold opening is completed at latest. In an apparatus for practicing this method, a device for holding a product during mold opening and a device for pushing out a product are provided to the stationary metal mold side. Therefore, a product push out operation or a preparatory operation for it can be started immediately after the start of mold opening. Since the components to be moved during mold opening are only the movable platen and the movable metal mold, thus being light-weighted, the die casting cycle time is considerably shortened and the manufacturing cost is decreased. More specifically, during movement of the movable metal mold, the product push out device conventionally belonging to the movable metal mold, the core cylinder unit, and piping and switching units for the core cylinder are mounted to the stationary metal mold and the stationary platen side. Therefore, since the movable metal mold can be made thin and light-weighted, the molds can be opened/closed comparatively quickly while the inertia during motion can be small to reduce impact, and the power consumption can be reduced.

During mold opening, since a projection projecting sideways, such as a core cylinder, belongs to the stationary metal mold side and does not move, the safeness during work operation is increased. Since the core and push out cylinders do not belong to the movable metal mold side but are fixed to the stationary metal mold side, the piping and wiring for them are simplified compared to a conventional case wherein the core and push out cylinders move, and durability is increased.

Since part of the product push out device is not located at a small space behind the movable platen, unlike in the conventional case, but at a portion surrounded by a large space, like the rear portion of the stationary platen, mounting, removal, maintenance, and inspection can be facilitated.

What is claimed is:

1. A horizontal mold clamping vertical injection type die casting method comprising the steps of:

casting a molten metal into a cavity of metal molds clamped in a horizontal direction from a lower portion of mating surfaces of the molds;

opening the molds while holding a product obtained by solidification of the molten metal on a stationary metal mold side by engaging the product with an undercut portion of a slide core;

disengaging the undercut portion of said slide core from said product; and thereafter pushing out the product with a product push out device provided to the stationary metal mold side.

2. A method according to claim 1, wherein, the step of pushing out the product is started when a mold opening operation is completed.

3. A horizontal mold clamping and vertical injection type die casting apparatus which has movable and stationary metal molds that are clamped and opened in a horizontal direction and in which a molten metal is casted from an under side into a cavity defined between said stationary and movable metal molds that are clamped to manufacture a product by solidification of the molten metal, comprising:

a slide core moved downwardly and upwardly to be engaged and disengaged between said movable and stationary metal molds, respectively, so that a bottom surface of said slide core forms a wall of an upper portion of said cavity when said slide core is engaged between said movable and stationary metal molds, said slide core being provided with an undercut portion on the bottom surface thereof and holding the product at a position of the cavity of the stationary metal mold side by said undercut portion when said movable and stationary metal molds are opened; and means provided to the stationary metal mold side for pushing the product held by said slide core out of said position of the cavity.

* * * * *